United States Patent [19]

Linder et al.

[11] Patent Number: 5,020,498

[45] Date of Patent: Jun. 4, 1991

[54] FUEL INJECTION APPARATUS

[75] Inventors: Ernst Linder, Muehlacker; Helmut Rembold, Stuttgart; Manfred Wier, Anzing, all of Fed. Rep. of Germany

[73] Assignee: Robert Bosch GmbH, Stuttgart, Fed. Rep. of Germany

[21] Appl. No.: 452,090

[22] Filed: Dec. 18, 1989

[30] Foreign Application Priority Data

Dec. 30, 1988 [DE] Fed. Rep. of Germany ..... 3844365

[51] Int. Cl.[5] ..... F02M 47/02; F02M 45/08; F02M 57/02

[52] U.S. Cl. ..... 123/450; 123/446; 123/506

[58] Field of Search ..... 123/446, 447, 450, 506

[56] References Cited

U.S. PATENT DOCUMENTS

| | | | |
|---|---|---|---|
| 3,961,612 | 6/1976 | Okamoto et al. | 123/446 X |
| 4,381,750 | 5/1983 | Funada | 123/446 |
| 4,417,557 | 11/1983 | Walter | 123/446 X |
| 4,440,134 | 4/1984 | Nakao et al. | 123/447 |

FOREIGN PATENT DOCUMENTS

| | | | |
|---|---|---|---|
| 3342759 | 5/1984 | Fed. Rep. of Germany . | |
| 185866 | 10/1984 | Japan | 123/446 |

*Primary Examiner*—Tony M. Argenbright
*Attorney, Agent, or Firm*—Edwin E. Greigg; Ronald E. Greigg

[57] ABSTRACT

In a fuel injection apparatus having an injection nozzle opening at predetermined pressure, to which fuel is deliverable under pressure, the injection nozzle chamber communicates with a fuel supply line with the interposition of a check valve closing outward; the pressure in the fuel supply line is lower than the opening pressure of the injection nozzle. Furthermore, the injection nozzle chamber communicates with a work chamber of a spring-loaded work piston, the displacement motion of which for increasing the pressure in the nozzle chamber above the opening pressure of the injection nozzle is effected by relieving a second work chamber of the spring-loaded work piston under the influence of spring force.

19 Claims, 7 Drawing Sheets

FUEL INJECTION APPARATUS

BACKGROUND OF THE INVENTION

The invention relates to a fuel injection apparatus having an injection nozzle that opens at a predetermined pressure, and to which fuel can be delivered under pressure.

A fuel injection apparatus in which fuel is delivered from a high-pressure reservoir via an interposed magnetic valve to an injection nozzle opening at a predetermined pressure is known for instance from German Patent 33 42 759. In such known devices, fuel is delivered to the pressure reservoir under pressure, and pressure waves in the injection line can have a disruptive effect on the injection quantity.

OBJECT AND SUMMARY OF THE INVENTION

The object of the invention is to provide an apparatus of the above type in which a direct line connection to supply lines or pressure lines is avoided during the injection event itself, so that in this way the injection event and the course of injection are kept free of pressure waves that may arise in the supply line network. To attain this object, the apparatus according to the invention is essentially characterized in that the injection nozzle chamber communicates with a fuel supply line, via an interposed check valve closing toward the outside, and the pressure in the fuel supply line is lower than the opening pressure of the injection nozzle, and that the injection nozzle chamber communicates with a first work chamber of a spring-loaded work piston the displacement motion of which, in order to increase the pressure in the nozzle chamber above the opening pressure of the injection nozzle, is effected by relieving a second work chamber of the spring-loaded work piston under the influence of spring force. Because the injection event is tripped by a spring-loaded work piston, the, working stroke of which is tripped by the relief of a separate work chamber and thus takes place under the force of the spring, fuel at comparatively low pressure can be used to fill the nozzle chamber, and the pressure required for the injection is effected by the spring of the work piston. Since such relief of a second work chamber of the work piston can be controlled arbitrarily, the instant and quantity of injection can be adjusted precisely, regardless of the pressure conditions prevailing in the supply lines. In every case, a direct line connection with fuel supply lines is avoided during the injection event, so that pressure waves arising in such lines cannot affect the injection event itself.

In a particularly advantageous embodiment of the invention the spring-loaded work piston is embodied as a stepped piston, the second work chamber of which, located at the larger diameter, can be acted upon with pressure fluid counter to spring force or can be relieved of pressure fluid under the control of a magnetic valve, and the first work chamber of which located at the smaller diameter communicates with the injection nozzle chamber. In such an embodiment, the separate work chamber via which the spring of the work piston can be prestressed or relieved is attained with only one common structural component and in an entirely compact manner, and the end face oriented toward the nozzle chamber executes the pressure stroke for opening the closure device of the injection nozzle and for the injection event until such time as this second work chamber, by relief, permits the spring travel. At the same time the stepped piston means that with relatively low work pressures for prestressing the spring of the work piston, relatively high operating pressures in the interior of the nozzle are assured, which results in reliable lifting of the needle closure device and reliable injection.

The shutoff of the injection event can be attained particularly simply in that the work piston has a conduit leading from its end face oriented toward the nozzle chamber to a diversion bore or diversion groove disposed on the jacket. In such an embodiment, the injection is reliably interrupted whenever the work piston has executed its maximum working stroke, because then the diversion bore is in communication with suitably aligned bores of the pump piston bushing, and so the pressure can be decreased by diversion to a low-pressure chamber or tank. The fuel supply and hence the furnishing of the quantity of fuel to be injected by the work piston can be performed at relatively low pressure: care must merely be taken first that reliable filling of the nozzle chamber is assured, and second that the supply pressure not exceed the opening pressure of the injection nozzle. This can advantageously be done by incorporating a pressure limiting valve, disposed in particular in the bypass to a feedpump, into the fuel supply line toward the nozzle chamber.

To enable a largely freely selectable course of injection and in particular to subdivide the injection into a pre-injection and a main injection with simultaneous control of the instant of injection and of the quantity to be injected, the embodiment can be such that the second work chamber of the work piston can be acted upon with pressure fluid from a pressure fluid source via a pressure fluid line, with the interposition of a filler magnetic valve and/or a distributor valve. If an additional magnetic valve, as a filler magnetic valve, is incorporated into the line for acting upon the second work chamber, then upon prestressing of the spring a suitable volume to be injected can already be specified, and this kind of prespecified volume makes it possible in the relief of the separate work chamber to dispense with special timing limitations, because then the working stroke can be executed until reaching a stop or until reaching an overflow opening. If two magnetic valves are simultaneously disposed for the separate quantity specification in the charging stroke of the work piston and the metered ejection, then even complex injection events can be controlled precisely in terms of quantity and time, without having to fear any after-effects of pressure waves in the line system.

In a particularly simple manner, this kind of simultaneous control of the injection quantity and the instant of injection, and a subdivision of the injection event for instance into a preinjection and a main injection can be attained in that a check valve closing toward the pressure fluid source is incorporated into the pressure fluid line to the second work chamber of the work piston, and that a branch line, as a relief line, having the magnetic valve that can be opened to relieve the second work chamber is connected downstream of the check valve. With this kind of arrangement, the expense for lines is reduced, and via the branch line the controlled relief and hence limitation of the preinjection and main injection can be attained; via the check valve closing toward the pressure fluid source, a quantity of pressure fluid metered or limited in quantity only by the size of the second work chamber can be used as needed at any time for loading the force accumulator or the spring.

In order to make at least partial use of the pressure level of the fuel drawn from the second work chamber of the work piston for tripping an injection, the embodiment is advantageously such that the relief line of the second work chamber of the work piston discharges into the fuel supply line to the nozzle chamber.

The shutoff of the injection event, as already mentioned above, can be effected via a diversion bore connecting the end face of the work piston, oriented toward the nozzle chamber with a point on the jacket, to which end naturally a suitable bore must be provided in the cylinder of the work piston, as an overflow opening. The same overflow or diversion bore on the wall of the cylinder can, however, also be used for other purposes, and in this respect the embodiment according to the invention is advantageously such that within the maximum displacement path of the work piston, in the cylindrical wall surrounding it, a diversion bore is disposed, which can be overtaken by an end face, defining the second work chamber of the work piston and/or by the diversion bore or diversion groove communicating with the end face of the work piston oriented toward the nozzle chamber. If this kind of overflow or diversion bore, which may be embodied for both events by a common bore in the cylinder wall, is overtaken by one edge of the portion of the work piston defining the second work chamber, then the loading or tensing of the spring is ended, so that in this way a simple stroke limitation in the loading process or tensing process of the force accumulator or spring is effected.

An embodiment of particularly simple structure for supplying the nozzle chamber with fuel can be attained in that the check valve in the fuel supply line for the nozzle chamber is disposed in an axial bore or opening of the work piston, and that the fuel supply line is connected to the spring chamber of the work piston. In this case,,the feeding of fuel can be effected via the spring chamber of the work piston, although in that case care must be taken that this spring chamber be filled only with low pressure, and moreover this pressure must be kept constant via a pressure maintenance valve, in order not to hinder the loading stroke of the work piston.

In a particularly simple circuit arrangement, the embodiment may be such that, for the pressure fluid supply line to the second work chamber and the fuel supply line to the nozzle chamber, a common feed pump is provided, having a lower feed pressure than the opening pressure of the injection nozzle. In this kind of embodiment, a separate high-pressure side for loading and tensing the spring can be dispensed with; if a common feed line to the nozzle needle chamber and to the second work chamber of the work piston is used, a check valve closing toward the line into the separate work chamber upon the relief thereof need merely be built in, in order to assure reliable injection.

The stepped piston preferably used can particularly simply be embodied in two parts, with the two parts ofthe work piston being supported such that they can be pressed resiliently against one another. The smaller portion of the work piston, oriented toward the nozzle chamber, may be supported via a spring in the interior of the injection nozzle chamber. Supply to a plurality of such work pistons, each associated with one injection nozzle, can be attained in the conventional manner via a distributor shaft; if reservoirs are used in the high-pressure side for supplying pressure fluid to the second work chamber, then even a plurality of such work pistons can readily be prestressed simultaneously, or equally preferably, the loading or tensing of a spring of a work piston of an injection nozzle can be effected to such an extent that at least two pre-injections and/or main injections are made possible before the next process of loading or tensing the spring that loads the work piston.

To enable furnishing a suitable quantity of pressure fluid for loading the force accumulator or tensing the spring of the work piston at any time, the embodiment is advantageously such that the pressure fluid source for acting upon the second work chamber of the work piston is embodied as a high-pressure pump communicating in particular with a reservoir. The use of high pressure for prestressing the spring or for loading the pressure reservoir enables entirely rapid tensing, and the fact that such a pressure fluid source having high pressure is used solely to load or tense the spring, but not during the actual injection event for attaining the injection, leads to perfect separation of high-pressure lines from the injection event.

Instead of a high-pressure pump with particularly low fluctuations in the feed flow and the associated relatively expensive design of the pump, the embodiment can in a simple manner be such that the pressure fluid source for acting upon the second work chamber of the work piston is embodied as a single-cylinder eccentric pump, the drive shaft of which is coupled with a rotatable distributor valve in the pressure fluid line leading to the second work chamber of the work piston. Depending on the variable rpm of the drive shaft of the pump and of the distributor valve, upon each loading event the injection quantity for a plurality of injection events at a time, along with the corresponding compression quantities, are pre-stored, and with this kind of embodiment pre-injection events can be shifted via the rotatable distributor valve to well inside the intake stroke of the individual cylinders. Because of the size of the work chamber of the pump, an additional reservoir can then be dispensed with.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
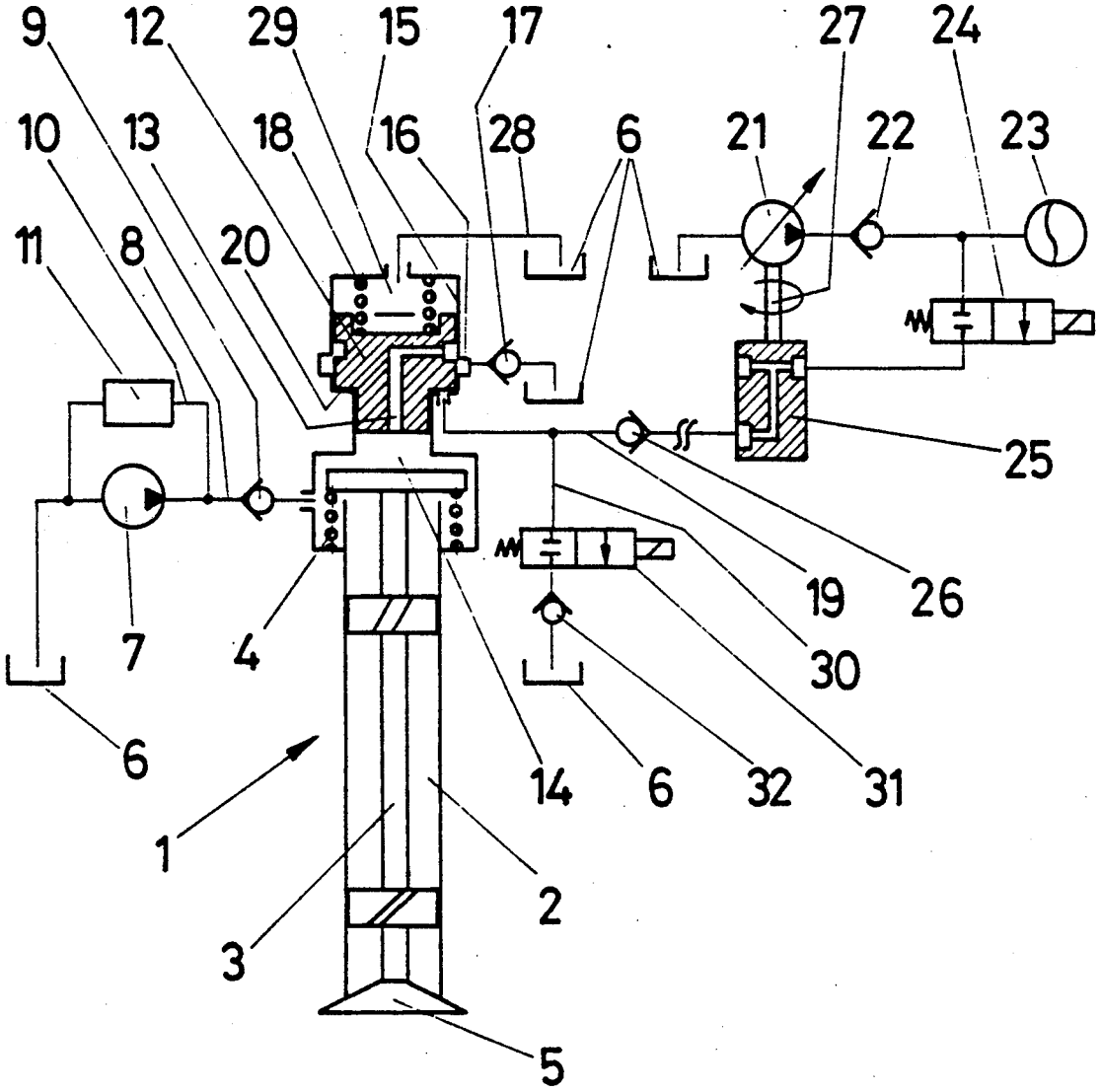
FIG. 1 is a first exemplary embodiment of a fuel injection apparatus according to the invention.

In FIG. 1, an injection nozzle 1 is shown, in the nozzle chamber 2 of which a nozzle needle 3 uncovers injection ports counter to the force of a spring 4, with suitable action by fuel at high pressure causing the lifting of a valve closing element 5. The delivery of fuel to the nozzle chamber or nozzle needle chamber 2 is effected from a tank 6 by a pump 7 via a check valve 9 incorporated into the supply line 8; a pressure limiting valve 11 is provided in a bypass 10 of the pump 7. The delivery pressure of the fuel delivered via the line 8 is below the opening pressure for the nozzle needle.

In the position shown in FIG. 1, filling of the nozzle chamber 2 with fuel and simultaneous flushing of the nozzle chamber or spring chamber 2 of the nozzle needle 3 is effected via a conduit 13 provided in a metering piston 12, embodied as a stepped piston; this conduit establishes communication between the first work chamber 14 of the stepped piston 12 oriented toward the nozzle chamber and an annular control groove 16 provided on the jacket of the guide bore 15 of the stepped piston 12. Via the conduit 13 and the annular control groove 16, the return of fuel introduced into the nozzle chamber 2 and the work chamber 14 to a return line or tank is effected via a further check valve 17. For the sake of simplicity, it is assumed below that all the return or suction lines discharge, into the common tank 6. The stepped piston 12 is kept in its outset position by a spring 18.

For prestressing or loading the work piston 12, pressure fluid is carried via a pressure line 19 at a pressure of 250 bar, for example, into a second work chamber 20, located at the larger diameter, of the work piston 12. The pressure fluid is delivered at such high pressure by a high-pressure pump 21 via a check valve 22 to a reservoir 23, from which the pressure fluid is delivered, via a magnetic valve 24 and a distributor shaft 25 coupled in simple fashion to the high-pressure pump 21, through the corresponding line 19, via the check valve 26, to the second work chamber 20 of the metering piston or work piston 12. The distributor shaft 25 is coupled to the drive of the high-pressure pump 21, as indicated by the arrow 27, and depending on the rotational position of the distributor shaft 25 with the magnetic valve 24 open, communication is established between the pressure reservoir 23 or high-pressure pump 21 and the second work chamber 20, located at the larger diameter, of a particular work piston 12. Via the magnetic valve 24, the quantity of fuel delivered to the second work chamber 20 and thus the extent of the displacement motion of the work piston 12 can be adjusted to meet requirements; as a result, the quantity of fuel subsequently available for an injection is established in the nozzle chamber 2 and in the first work chamber 14. A relief line 28 is provided from the chamber 29, receiving the spring 18 and located remote from the work chambers 20 and 14, to the tank 6.

To trigger an injection, a branch line 30 is connected to the line 19 between the check valve 26 and the second work chamber 20 of the work piston 12; in the branch line, a magnetic valve 31 and a check valve 32 are provided in series. Upon the switchover of the magnetic valve 31, that is, upon opening of the connection between the second work chamber 20 of the work piston 12 and the tank 6, the spring 18 presses the metering piston 12 toward the nozzle needle 3; as a result the fuel contained in the first work chamber 14 and in the nozzle chamber 2 is put under pressure. Once the nozzle opening pressure is exceeded, a corresponding quantity is ejected via the outwardly opening nozzle needle. Via the check valve 9 in the supply line 8, feedback into the supply line 8 is avoided during the pressure build up and during the injection event, just as the check valve 26 in the supply line to the second work chamber 20 of the work piston 12 prevents feedback to the distributor shaft 25 or to the magnetic valve 24. The injection event can be effected by a closure once again of the magnetic valve 31, so that by defining the instant of opening and the duration of opening of the magnetic valve 31, the injection event can be separated in a simple manner into a pre-injection and a main injection. In the event that the entire fuel quantity contained in the first work chamber 14 and the nozzle chamber 2 is to be expelled, then with complete evacuation of the second work chamber 20 located at the larger diameter, a relief of the nozzle chamber 2 and the first work chamber 14 is effected via the conduit 13 in the work piston 12 and via the control groove 16. However, the injection event can be terminated at any time prior to this ending of the injection that occurs in any case, by means of a closure of the magnetic valve 31.

Thus the instant of injection is determined via the magnetic valve, while the injection quantity can be determined both via the ON time of the magnetic valve 24 and hence the fill time of the second work chamber 20 of the work piston, and via the ON time of the magnetic valve 31. The advantage of the injection effected by the purposeful relief of the metering or work piston 12 is that after the prestressing of the work piston 12, there is no further communication with the high-pressure reservoir 23 via the distributor shaft 25, so that any pressure waves that might occur no longer have any disruptive influence on the injection quantity. When the relief of the separate work chamber 20 via the magnetic valve 31 begins, the communication with the feed pump, which may be embodied as an electric fuel pump, is closed via the check valve 9, so that a defined quantity of fuel at a predetermined pressure is contained in the nozzle chamber 2 and the first work chamber 14, which is thus in communication with it, of the work piston 12.

Figure 2:
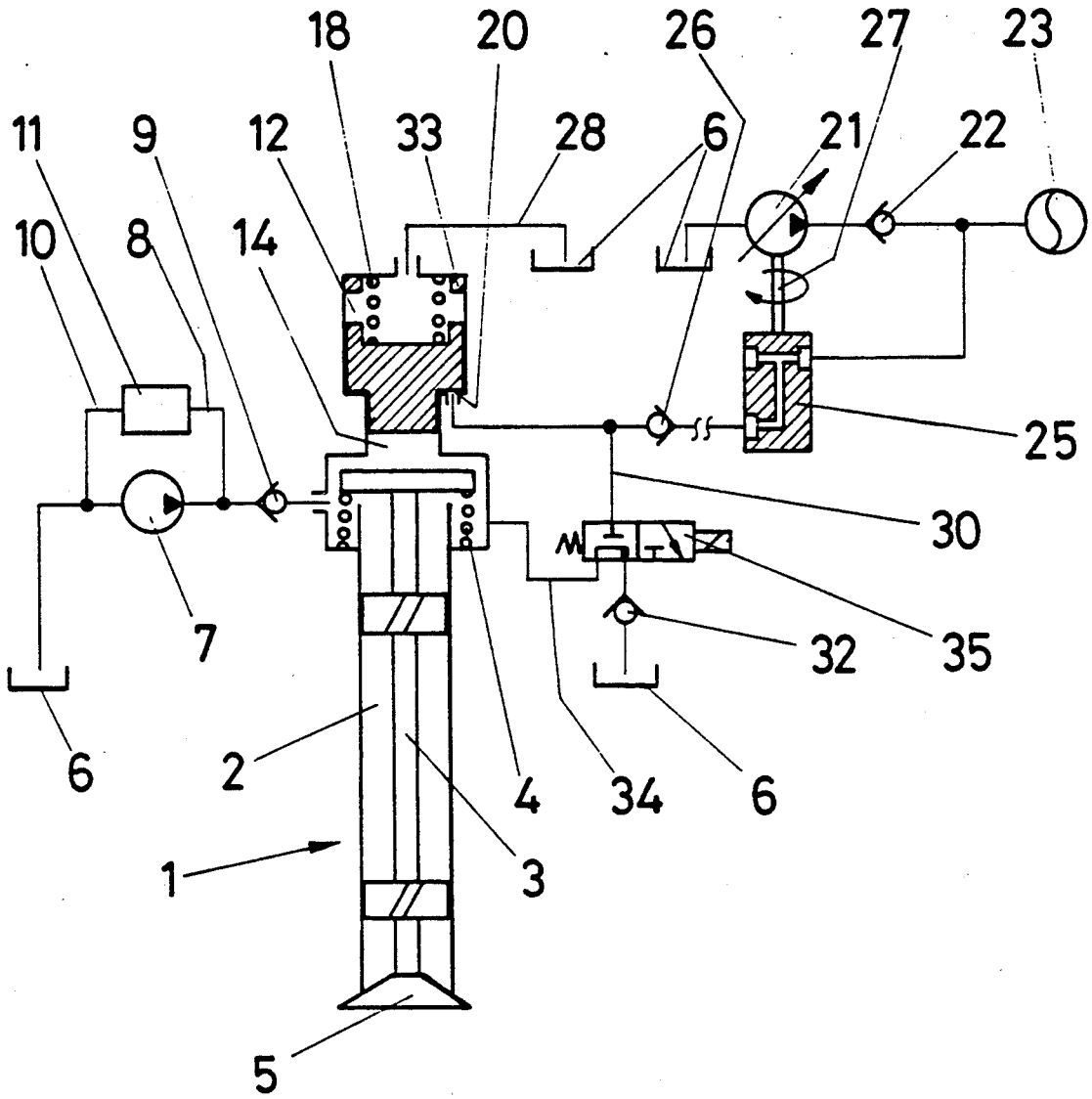
FIG. 2 is a modified embodiment of a fuel injection apparatus according to the invention.

FIG. 2 shows a modified embodiment of the fuel injection apparatus, in which metering via the magnetic valve preceding the distributor shaft 25 is dispensed with. In this case, the work piston is prestressed in accordance with the rotational position of the distributor shaft, up to an upper stop 33. The filling of the nozzle needle chamber 2 or first work chamber 14 takes place similarly to the embodiment of FIG. 1. For flushing the nozzle needle chamber 2, in a distinction from the embodiment of FIG. 1, a drain line 34 is connected to the nozzle chamber 2, and this line, in a switching position of a 2/3-way magnetic valve 35, communicates with the branch line 30 to the tank 6 upstream of the check valve 32 that maintains the flushing pressure. This magnetic valve 35 simultaneously serves as a relief valve for the first work chamber 20 located at the larger diameter of the work piston 12, and via the magnetic valve 35 alone, the instant and quantity of injection are determined by the instant the valve switch is on and the ON time. By suitable control, once again a separation of the injection into a pre-injection and main injection is attained. The stroke of the work piston 12 is selected such that the lower stop is not attained, so that a complete relief of the second work chamber 2 is not attained. Besides the flushing of the nozzle chamber 2 in the closed position of the magnetic valve 35 for the relief of the second work chamber 20, the defined relief of the nozzle interior 2 is also effected to terminate an injection, with the magnetic valve embodied as a 3/2-way valve.

Figure 3:
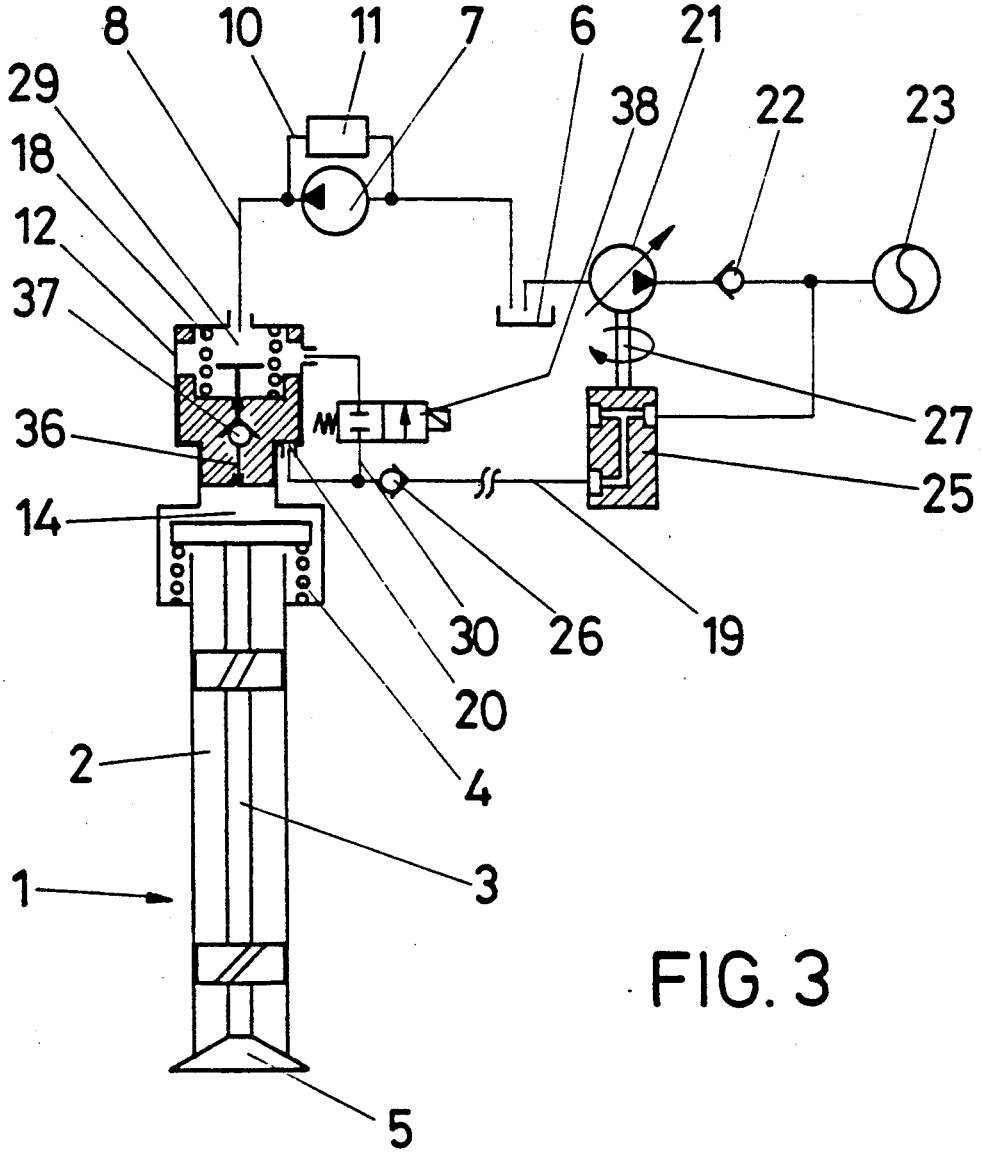
FIG. 3 is a further modified embodiment, in which the fuel supply line into the nozzle chamber extends via the spring chamber of the work piston.

In the exemplary embodiment of FIG. 3, the supply of fuel to the first work chamber 14 or to the nozzle chamber 2 is effected via the chamber 29 receiving the spring 18 for acting upon the work piston 12 via a substantially axial conduit 36 in the interior of the work piston 12, which have a check valve 37 closing toward the chamber 29 and toward the supply line 8. The prestressing of the work piston 12 by introducing pressure fluid at high pressure is effected as in the exemplary embodiment of FIG. 2; that is, the metering or work piston 12 is moved up to its upper stop. The relief of the second work chamber 20 and thus the initiation of an injection event take place once again via a magnetic valve 38, which is embodied simply as a 2/2-way valve, and the relief line 30 connected to the supply line 19 in this exemplary embodiment discharges into the spring chamber 29 of the work piston 12.

Figure 4:
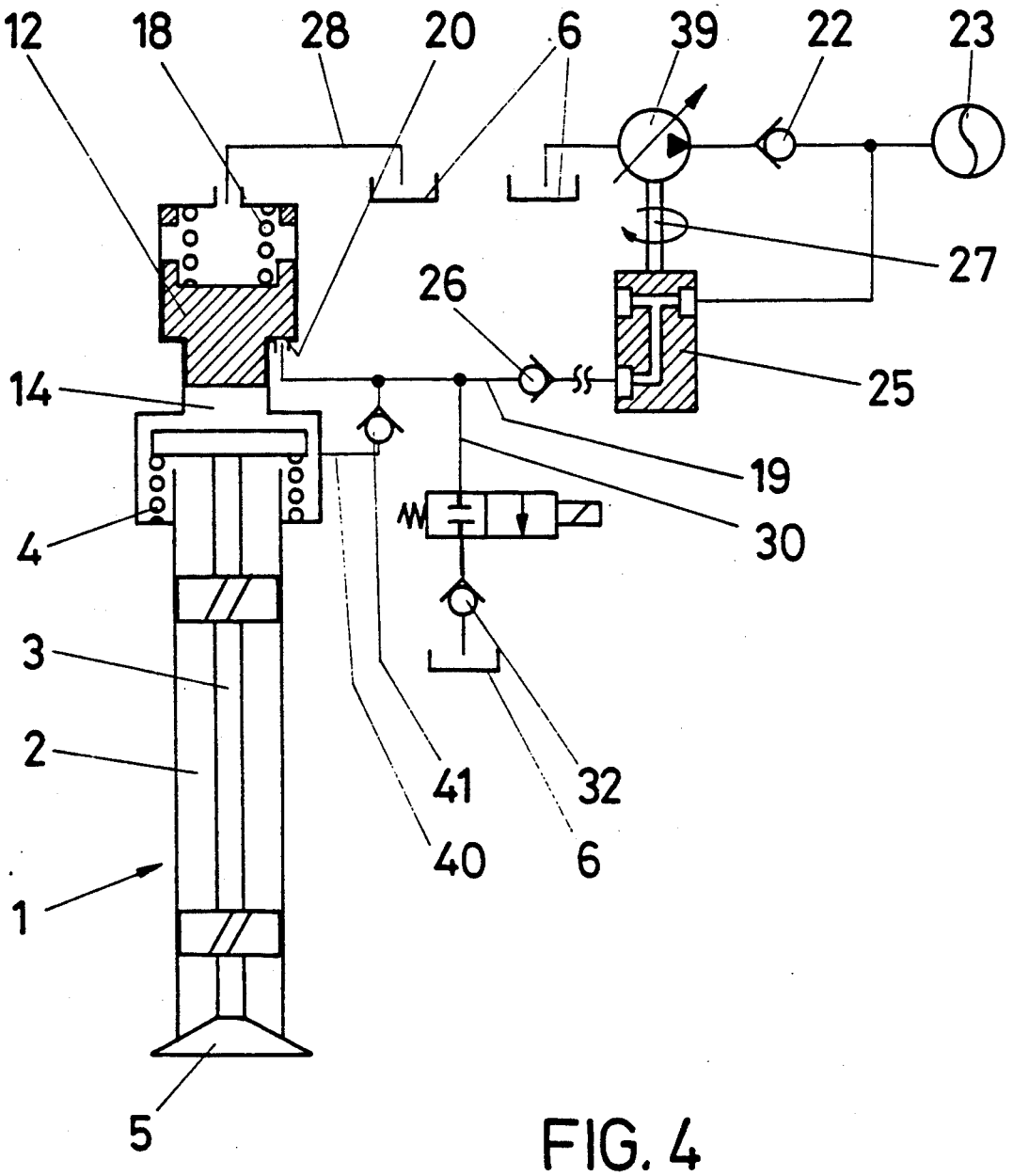
FIG. 4 is an embodiment of a fuel injection apparatus according to the invention, in which the pressure fluid supply line to the second work chamber and the fuel supply line to the nozzle chamber are effected via a common feed pump.

In the exemplary embodiment shown in FIG. 4, a common pressure fluid source 39, for instance embodied by a low-pressure pump having a maximum pressure of approximately 60 bar, is used both for prestressing of the work piston 12 or in other words for filling of the second work chamber 20 located at the larger diameter, and for filling the nozzle chamber 2 and the first work chamber 14 of the work piston 12. An important aspect of this embodiment is that the maximum pressure of the low-pressure pump 39 be below the nozzle opening pressure of approximately 120 bar. Similarly to the exemplary embodiments described above, a reservoir 23 is once again used, and the filling and prestressing of the work piston 12 again take place via a distributor shaft 25. Thus in this exemplary embodiment the separate pump for supplying fuel to the nozzle interior is omitted. A line 40 leading into the nozzle chamber 12 and to the first work chamber 14 of the work piston is connected to the supply line 19, and a check valve 41 closing outward is again provided in the line 40, performing the function of the check valve 9 of the previous exemplary embodiments. To relieve the second work chamber 20 and thus to initiate or perform an injection event, a magnetic valve 42 is once again used, which is disposed in a branch line 30 of the pressure line 19 as in FIG. 1, upstream of the check valve 32.

The pressure generated by the spring 18 acting upon the work piston 12 in a relief of the second work chamber 20 should be approximately 200 bar; this can be attained by suitable dimensioning of the area of the step, or in other words by suitable dimensioning of the piston surfaces oriented toward the work chamber 14 or 20.

Figure 5:
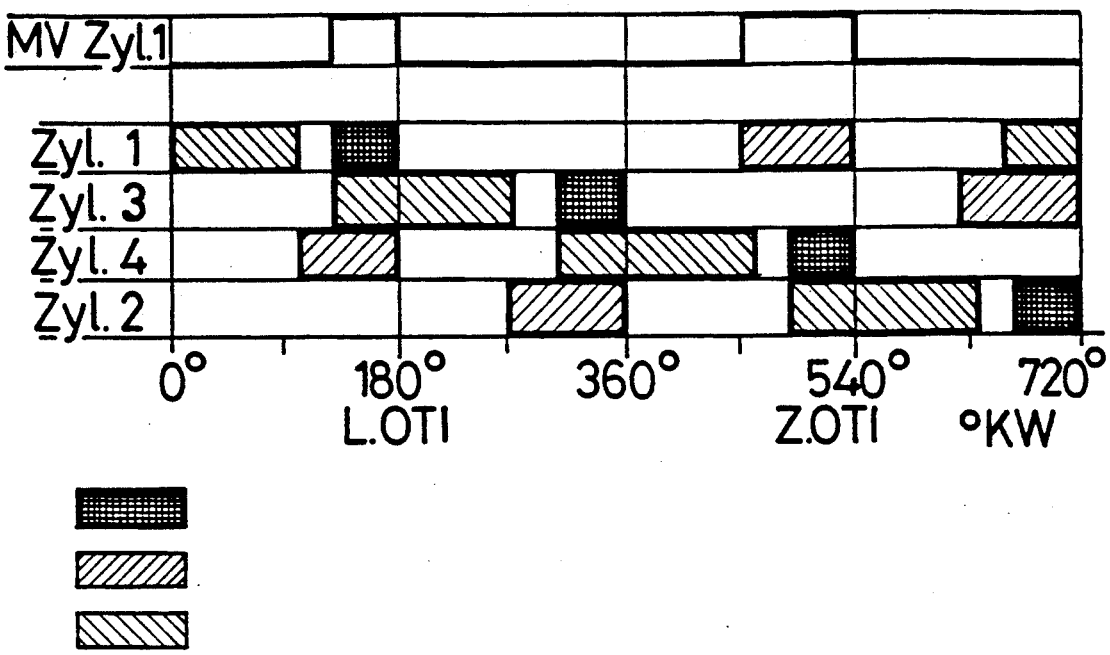
FIG. 5 is a diagram showing the instants of injection of an internal combustion engine having four cylinders and a fuel injection apparatus as shown in FIG. 4.

FIG. 5 is a schematic injection diagram for an internal combustion engine equipped with four cylinders and having a fuel injection apparatus in accordance with the embodiment shown in FIG. 4. The crankshaft angle is plotted on the abscissa, and for the various cylinders the corresponding angle ranges in which the work piston 12 is prestressed and in which a pre-injection or a main injection take place are shown by different kinds of shading. The position of the magnetic valve 42 associated with a first cylinder is also indicated, with a pre- or main injection taking place in the respective opening position of the magnetic valve 42. The angle ranges within which the work piston is prestressed result from the applicable rotational position of the distributor shaft 25 in which communication is established via the line 19 between the pump 39 or the reservoir 23 and the second work chamber 20 of the work piston. At the same time, in the exemplary embodiment of FIG. 4, a filling of the nozzle chamber 2 or first work chamber 14 is performed.

With the exemplary embodiments shown in FIGS. 1-3 as well, an injection behavior for various cylinders of an internal combustion engine is attained that largely corresponds to the diagram of FIG. 5.

Figure 6:
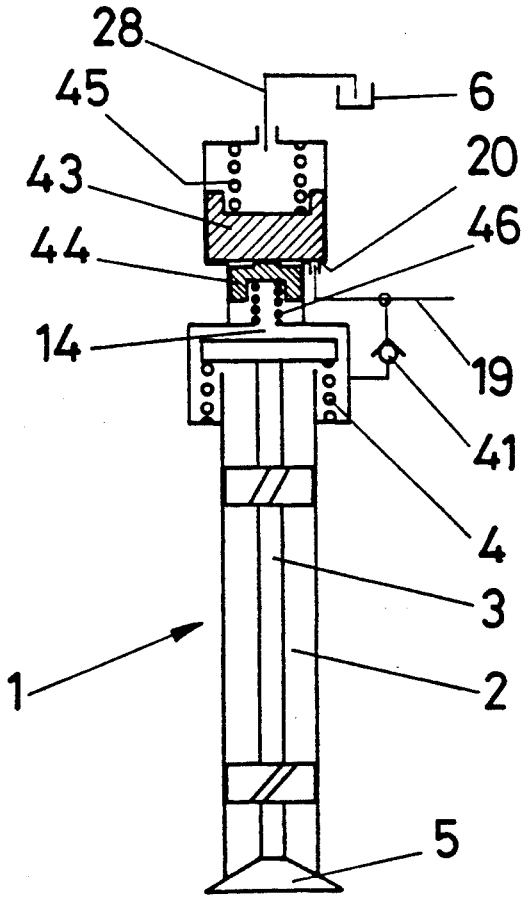
FIG. 6 shows a two-part work piston for disposition in a fuel injection apparatus according to the invention.

FIG. 6 shows only one injection nozzle with the associated work piston, which is in two parts in this embodiment, which makes manufacture easier. Similarly to the embodiment of FIG. 4, for filling the nozzle chamber 2 or first work chamber 14 and for prestressing the work piston comprising two parts 43 and 44, a common pressure fluid source is used. In the embodiment shown in FIG. 6, both work piston parts 43 and 44 can be pressed against one another by springs 45 and 46, respectively, and as in the above embodiments, for performing an injection event once again a relief of the second work chamber 20 located on the larger diameter of the two-part work piston is effected via a magnetic valve incorporated in a branch line to the supply line 19 and not shown in further detail here. The spring 46 acting upon the piston 44 oriented toward the nozzle needle 3 is supported on the housing of the injection nozzle 1 in a manner structurally connected to the housing. In the prestressing of the two-part work piston 43, 44, or in other words when action is exerted upon the second work chamber 20, care must be taken by suitable dimensioning of the spring forces of the springs 45 and 46 and the dimensioning of the pistons 43 and 44 that the pressure acting upon the piston 44 oriented toward the nozzle needle not be sufficient for corresponding displacement of the piston 44 toward the nozzle needle, so as to build up a pressure in the first work chamber 14 or nozzle chamber 2 that exceeds the opening pressure of the nozzle needle 3. Instead, for operation in a defined manner the spring 46 should be dimensioned sufficiently so that even in the prestressing of the piston 43 contact of the piston 44 with the piston 43 is assured.

Figure 7:
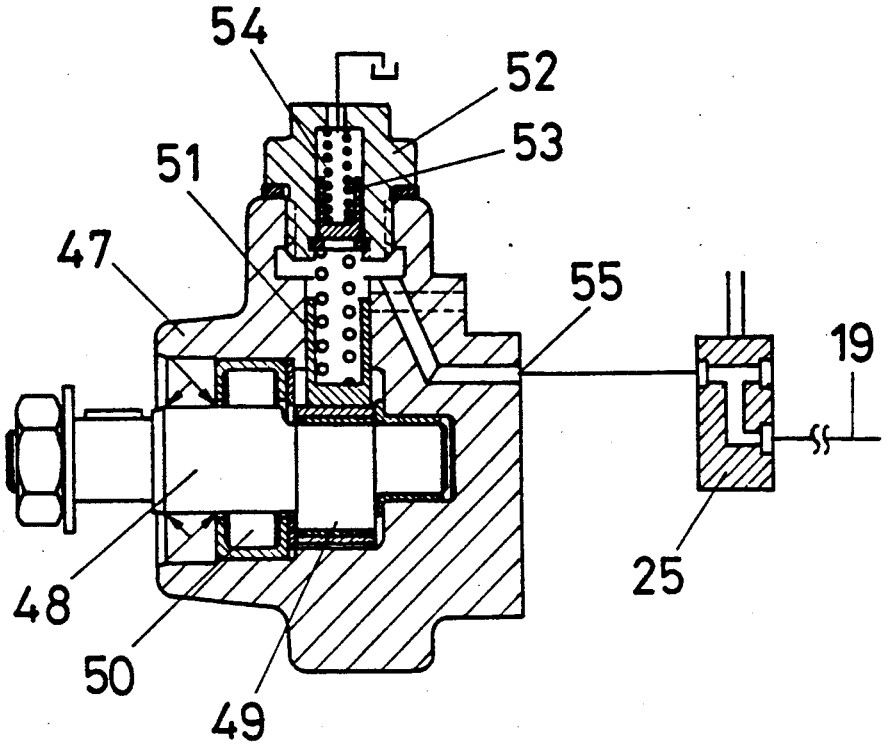
FIG. 7 shows an embodiment having a single-cylinder eccentric pump.
Figure 9:
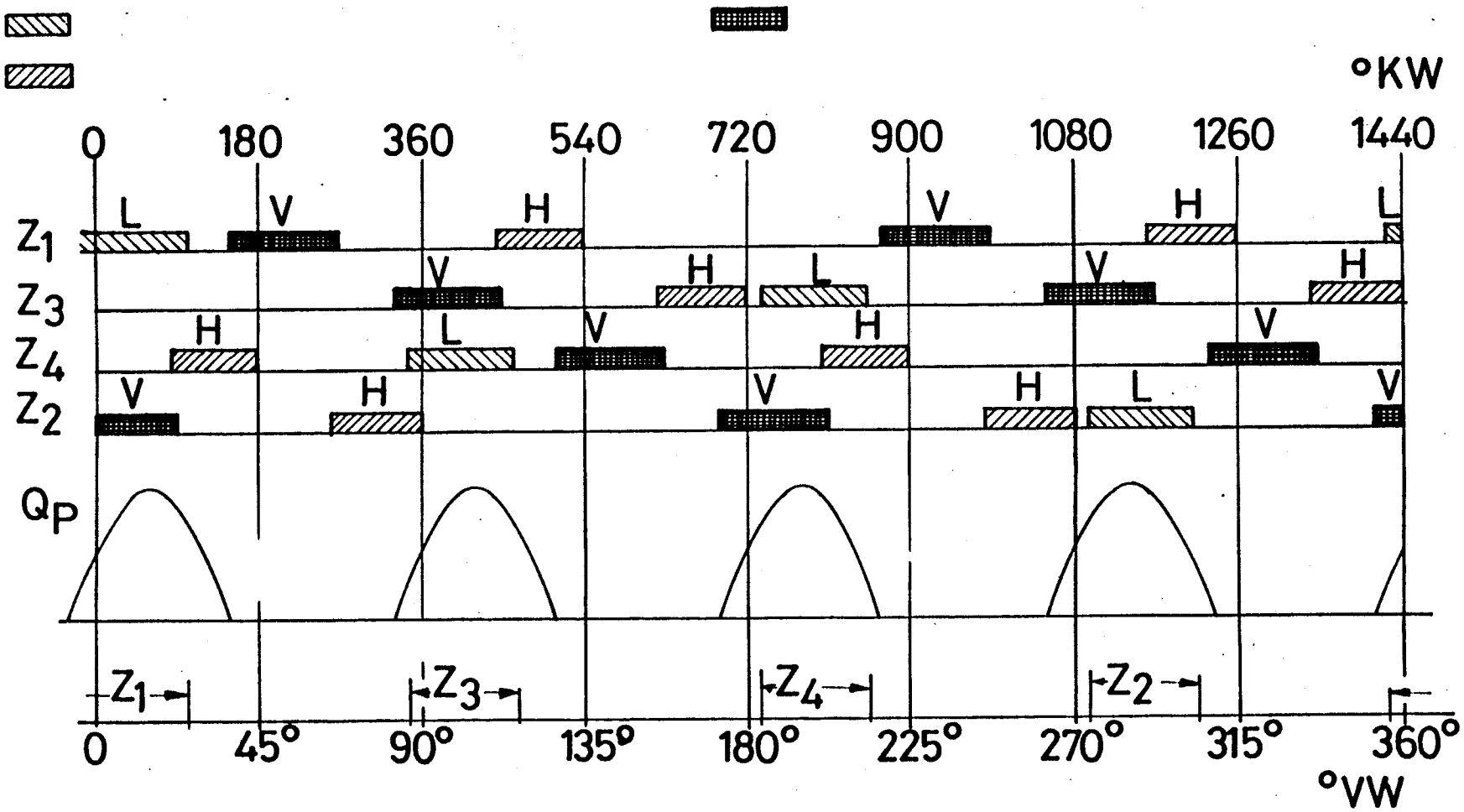
FIG. 9 is a diagram of the instants of injection in an embodiment a shown in FIGS. 7 and 8.

In the embodiments described above, it has been assumed that for generating pressure a pump 21 or 39 with as little feed flow fluctuation as possible is used. This means in general that pumps having at least three pistons are required. In FIG. 7, a version is shown in which this is attained with a single cylinder eccentric pump, the basic design of which is known in the art. In a pump housing 47, a drive shaft 48 having a drive cam 49 is supported in bearings 50, and a pump piston 51 is actuated by the drive cam. A reservoir piston 53 that is prestressed by a spring 54 in accordance with a response pressure of approximately 50 bar for the pump work chamber 58 is integrated into a closure screw 52 that closes off the pump work chamber 58 upstream of the pump piston 51. In FIG. 7, reference numeral 55 indicates the delivery conduit for fuel from the pump work chamber 58 of the spring-loaded pump piston 51 or from the reservoir chamber of the reservoir piston 53, to the distributor shaft 25. The pump rotates at the engine rpm and also drives the distributor shaft 25, which via a pair of gear wheels, not shown, rotates at one-fourth the rotational speed of the pump shaft 48. The check valve 22 is dispensed with here, which is possible if the metering piston meets a fixed stop. The control of the conduit 55 is performed by the distributor shaft. The aspiration takes place under control of an intake slit. The nozzle embodiment following the distributor shaft 25 via the supply line 19 is equivalent to the embodiment shown in FIG. 4. The injection events, or events of charging the work pistons of a four-cylinder internal combustion engine, in a version of the pump shown in FIG. 7, are shown in FIG. 9. On the abscissa, the crankshaft angle is plotted at the top of the diagram, and the distributor shaft angle is plotted on the bottom. A decisive factor is that in each charge event, that is, each time the second work chamber 20 is filled for each work piston 12, and in the filling of the nozzle chamber 2 or first work chamber 14 of the corresponding injection nozzle 1, the injection quantities including the compression quantities for two injection events at a time must be introduced, with the compression quantity to be used only once. The definition of the instant and quantity of injection is again effected via the controlled relief of the second work chamber of the work piston via a corresponding magnetic valve. As can be seen from FIG. 9, the process of charging the metering or work piston for cylinders 1 and 3, and 2 and 4, respectively, is done in different feed ranges of the pump. Different system pressures during the charge process can be avoided by embodying the reservoir piston spring 54 as a soft spring. Since after the decoupling of one supply line 19 by suitable rotation of the distributor shaft 25, the respective spring in the metering piston or work piston in each case determines the system pressure, and thus the pressure does not entail any disadvantages.

Figure 8:
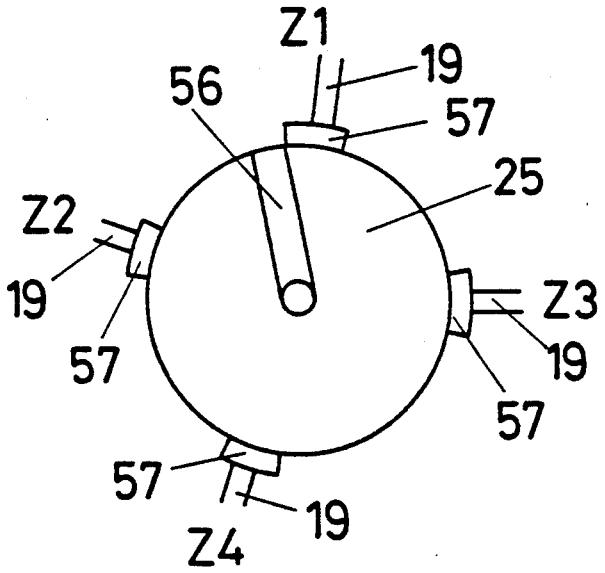
FIG. 8 is a section through a distributor shaft used in an embodiment as shown in FIG. 7.

FIG. 8 shows a section through the distributor shaft 25 used in the embodiment of the pump of FIG. 7, with the control angle of the distributor shaft 25 for the various cylinders. A distributor bore 56 can be seen, which communicates with various supply lines 19 to the cylinders at the suitable rotational position of the distributor shaft, over an angle range correspondingly defined by control grooves 57. In this version the pre-injection can be shifted to far within the intake stroke, which may be advantageous for a specific engine, since in a pre-injection at load change at top dead center there is the danger that uncombusted fuel will pass through the still-open outlet valve to reach the exhaust.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. A fuel injection apparatus having an injection nozzle opening at predetermined pressure, to which fuel is deliverable under pressure, comprising an injection nozzle chamber (2) communicating with a fuel supply (8, 40) provided with a check valve (9, 37, 41) closing toward the outside, said check valve adapted to maintain a pressure in the fuel supply line (8, 40) lower than an opening pressure of the injection nozzle, the injection nozzle chamber (2) further communicating with a first work chamber (14) of a spring-loaded work piston (12, 43, 44), said spring-loaded work piston having an associated second work chamber (20) subject to spring loading from said work piston, said spring-loaded work piston being adapted to be displaced to increase pressure in the nozzle chamber (2) above the opening pressure of the injection nozzle (1) by relieving pressure in said second work chamber (20).

2. A fuel injection apparatus as defined by claim 1, in which the spring-loaded work piston comprises a stepped piston (12, 43, 44), the second work chamber (20) of which is located at a larger diameter thereof, said second work chamber being acted upon with pressure fluid counter to spring force or relieved of pressure fluid under control of a magnetic valve (24, 31, 35, 38, 42), and the first work chamber (14) of which stepped piston is located at a smaller diameter so as to communicate with the injection nozzle chamber (2).

3. A fuel injection apparatus as defined by claim 1, in which the work piston (12) has a conduit (13) leading from its end face oriented toward the nozzle chamber (2) to a diversion means (16) disposed on a jacket face of the work piston.

4. A fuel injection apparatus as defined by claim 2, in which the work piston (12) has a conduit (13) leading from its end face oriented toward the nozzle chamber (2) to a diversion means (16) disposed on a jacket face of the work piston.

5. A fuel injection apparatus as defined by claim 1, in which a pressure limiting valve (11) is disposed in the fuel supply line (8) toward the nozzle chamber, in a bypass (10) to a feed pump (7).

6. A fuel injection apparatus as defined by claim 1, in which the second work chamber (20) of the work piston (12) can be acted upon with pressure fluid from a pressure fluid source (23) via a pressure fluid line (19) via interposition of a valve means.

7. A fuel injection apparatus as defined by claim 6, in which said valve means is a filler magnetic valve.

8. A fuel injection apparatus as defined by claim 6, in which said valve means is a distributor valve.

9. A fuel injection apparatus as defined by claim 5, in which a check valve (26) closing toward the pressure fluid source (21, 23, 39) is incorporated into the pressure fluid line (19) to the second work chamber (20) of the work piston (12), and a branch line having the magnetic valve (31, 35, 38, 42) that can be opened to relieve the second work chamber (20) is connected as a relief line (30) downstream of the check valve (26).

10. A fuel injection apparatus as defined by claim 1, in which the relief line (30) of the second work chamber (20) of the work piston (12) discharges into the fuel supply line (8, 29) to the nozzle chamber (2).

11. A fuel injection apparatus as defined by claim 3, in which said diversion means (16) is disposed in a cylindrical wall (15) surrounding the work piston within a maximum displacement path thereof and communication can be established with said diversion means by an end face defining the second work chamber (20) of the work piston (12) and by the diversion means communicating with the end face of the work piston oriented toward the nozzle chamber (2).

12. A fuel injection apparatus as defined by claim 2, in which a check valve in the fuel supply line for the nozzle chamber (2) is disposed in an axial bore (36) of the work piston (12), and the fuel supply line (8) is connected to the spring chamber (29) of the work piston (12).

13. A fuel injection apparatus as defined by claim 12, in which the check valve (37) in the fuel supply line for the nozzle chamber is disposed in an axial bore (36) of the work piston (12), and the fuel supply line (8) is connected to the spring chamber (29) of the work piston (12).

14. A fuel injection apparatus as defined by claim 1, in which a common feed pump (39) is provided for the pressure fluid supply line to the second work chamber (20) and the fuel supply line to the nozzle chamber (2), said feed pump having a lower feed pressure than the opening pressure of the injection nozzle.

15. A fuel injection apparatus as defined by claim 2 in which the work piston (43, 44) comprises two parts, the two parts of the work piston capable of being pressed resiliently against one another.

16. A fuel injection apparatus as defined by claim 6, in which the pressure fluid source for acting upon the second work chamber (20) of the work piston (12) comprises a high-pressure pump (21) communicating in particular with a reservoir (23).

17. A fuel injection apparatus as defined by claim 6, in which the pressure fluid source for acting upon the second work chamber (20) of the work piston (12) comprises a single-cylinder eccentric pump, said eccentric pump having a driveshaft (48) which is coupled with a rotatable distributor valve (25) in the pressure fluid line (19) leading to the second work chamber (20) of the work piston (12).

18. A fuel injection apparatus as defined by claim 3, in which said diversion means (16) is disposed in a cylindrical wall (15) surrounding the work piston within a maximum displacement path thereof and communication can be established with said diversion means by an end face defining the second work chamber (20) of the work piston (12).

19. A fuel injection apparatus as defined by claim 3, in which said diversion means (16) is disposed in a cylindrical wall (15) surrounding the work piston within a maximum displacement path thereof and communication can be established with said diversion means by the diversion means communicating with the end face of the work piston oriented toward the nozzle chamber (2).

* * * * *